United States Patent [19]

Reese et al.

[11] 4,068,895

[45] Jan. 17, 1978

[54] DEMOLITION MACHINE FOR DELINING A FURNACE

[75] Inventors: Roy C. Reese, Wheatfield, Ind.; Richard C. Wehrle, South Chicago Heights, Ill.

[73] Assignee: O. W. Reese, Inc., Wheatfield, Ind.

[21] Appl. No.: 701,503

[22] Filed: July 1, 1976

[51] Int. Cl.[2] ..... E04G 1/36; E21D 7/02

[52] U.S. Cl. ..... 299/70; 173/43; 173/46; 182/128

[58] Field of Search ..... 299/70; 173/43, 46, 173/28; 182/128; 175/315

[56] References Cited

U.S. PATENT DOCUMENTS

| | | | |
|---|---|---|---|
| 3,302,976 | 2/1967 | Grant | 299/70 |
| 3,370,888 | 2/1968 | Skendrovic | 173/43 X |
| 3,436,120 | 4/1969 | Armstrong | 173/43 X |
| 3,446,292 | 5/1969 | Stauffer | 173/43 X |

*Primary Examiner*—Ernest R. Purser

[57] ABSTRACT

The masonary or refractory material employed in the lining of blast furnaces has to be demolished, torn out, reconditioned, or replaced periodically, due to wear and deterioration of such material and the subject invention involves improved equipment or apparatus with respect to removing or delining this material.

More particularly, the equipment includes a lower rotatable oblong carriage supporting a mounting adjacent one extremity of the carriage which carries an articulated structure provided with a reciprocable tool for disintegrating the liner material, an upper support for the carriage, cable means extending from the support for connection with means for suspending the equipment in the furnace, and power operated cables extending from the support for connection with means on the wall of the furnace whereby the equipment can be controlled and stabilized by an operator on the carriage to locate the equipment on a vertical axis of the furnace or in any one of an infinite number of radial and/or circumferential positions with respect thereto so as to facilitate locating the tool for efficient operation against the refractory liner in the furnace. The cable means and cables are extensible and extend only from the support so that they will not interfere with the rotation of the carriage and/or operation of the articulated structure and tool.

29 Claims, 9 Drawing Figures

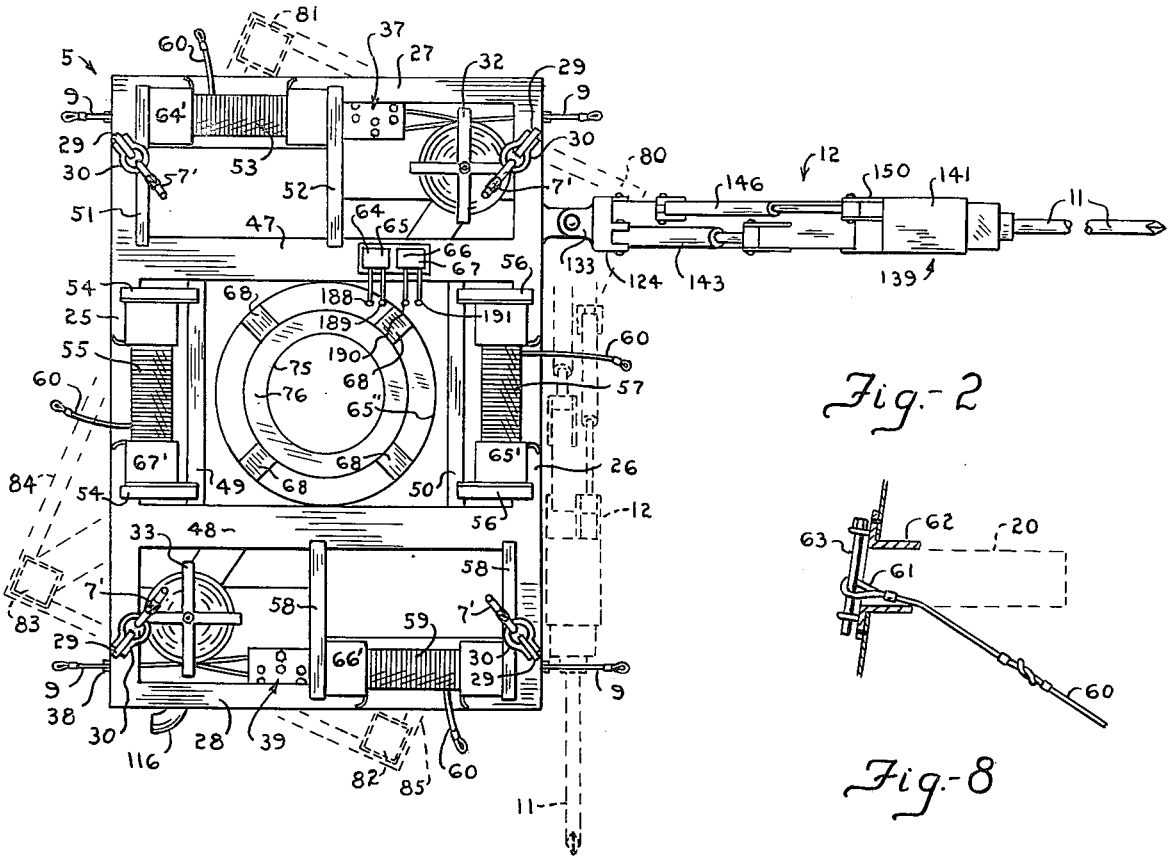
Fig.-2
Fig.-8
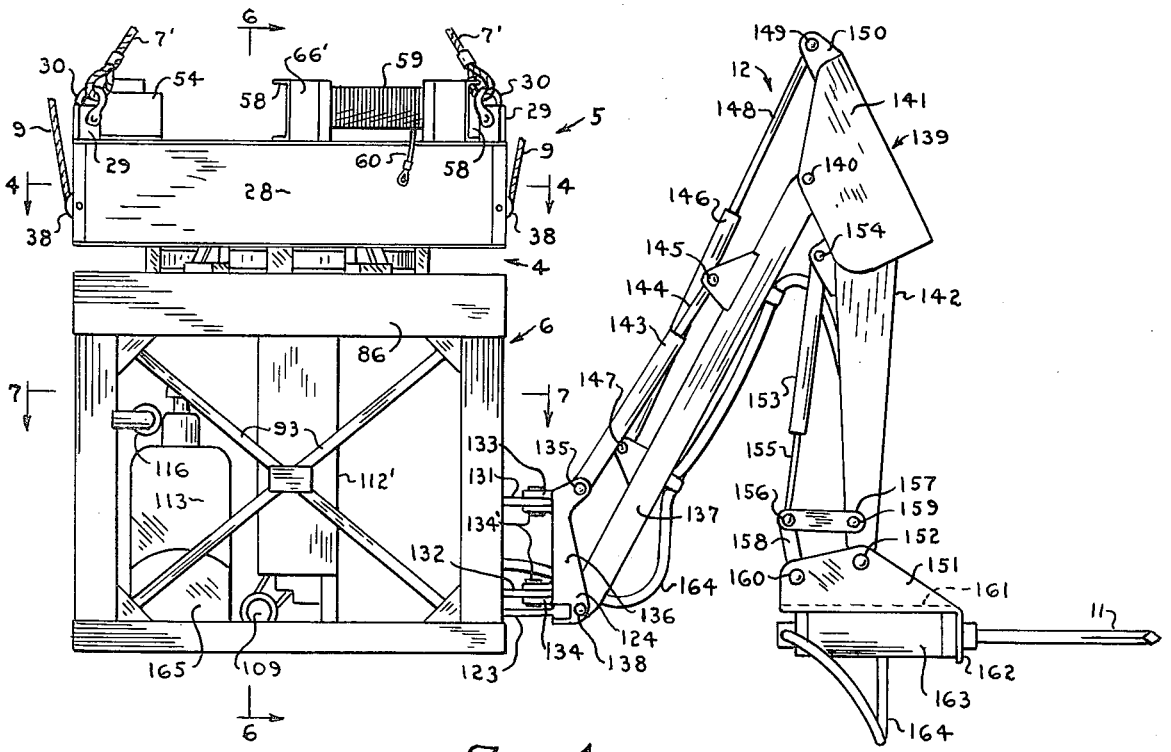
Fig.-1

DEMOLITION MACHINE FOR DELINING A FURNACE

BACKGROUND

Quite a number of different machines have heretofore been employed for the purpose of delining the masonry or refractory inner wall of a blast furnace and the subject invention is considered to constitute improvements over the equipment or machines disclosed in various patents, such as for example, J. Armstrong U.S. Pat. No. 3,436,120 dated Apr. 1, 1969 which, among other things, discloses a platform which is held in the center of a furnace throughout the entire tear-down operation; D. R. Stauffer, U.S. Pat. No. 3,446,292 dated May 27, 1969, which shows a rig or platform held by outriggers engaging a furnace wall and tool structure carried and supported below the platform; and L. Skendrovic, U.S. Pat. No. 3,370,888 dated Feb. 27, 1968 which is similar to the aforesaid Stauffer Patent in that a tool structure is mounted below a support substantially on a vertical axis and carries complicated radially movable outriggers which abut the wall of a furnace and appear to continually maintain the machine centered on such axis.

In addition to the above, some machines used in the past require periodic adjustment of cables from the top of the furnace by a crew of men to lower the machine to many positions in the furnace as the liner therein is removed, as distinguished from the subject invention which, among other things, allows an operator on the machine to control such procedure, thereby materially affording a reduction in manpower.

The improvements constituting the subject invention or inventions will readily become apparent after the following OBJECTIVES AND DESCRIPTION are considered as hereinafter set forth.

OBJECTIVES

One of the important objects of the invention is to provide apparatus which is capable of delining furnaces of variable sizes or cross-dimensions without the need of utilizing several machines for such purpose.

A significant objective is to provide a machine embodying, among other things, an upper support or platform, and a lower carriage or cage in which the power therefor is preferably in the form of a small deisel motor which is self-contained in the carriage, as distinguished from those machines which require a multiplicity of power and/or feed lines which connect the machines to a source of power or supply lines located exteriorly and remote from the furnace. Such lines are expensive, require maintenance, cause entanglements and annoyance, and are not as safe or reliable as a substantially self-contained structure. In this regard, some of those machines require a water line to cool the hydraulic system and such a line, subject to freezing in winter and leakage into the lower refractory material causing possible damage thereto, is not needed. More specifically, the machine or equipment embodying the subject invention does not need a heavy duty electric cable extending to the top and into a furnace from a power source which may be located an appreciable distance from the furnace. The electrical equipment used on some of the machines used by others is also subject to wet and extremely dusty conditions during teardown and its life span is relatively short, thereby requiring periodic attention, repair and labor costs. The machine of the subject invention is self-contained except for a primary hoisting mechanism and air to operate an air operated tool or hammer.

A very important object of the invention is to provide a machine with improved means whereby the machine can be adjusted to variable operative positions and stabilized within the confines of a furnace without utilizing complicated outriggers of the character disclosed, for example, in the above mentioned Patent of Lawrence Skendrovic. Such outriggers have to be extended appreciable radial distances to engage the wall of a furnace and are subject to great stress and breakdown. More explicitly, the improved means comprises providing the support, above referred to, with winch operated cables which are detachably connectible with the cylindrical wall of a furnace through the cooler holes therein to position the support or machine on center or outwardly therefrom. This improved means is relatively light in weight, strong, durable, compact and is easy to replace or repair.

A particular objective is to provide the support or platform with safety suspension cables which can be readily adjusted by an operator located in the carriage, as distinguished from being adjusted at the top of a furnace by a crew of men to make periodic adjustments as the machine is lowered for delining purposes, and thereby materially reduces the factor of manpower.

Also, an object is to provide a machine which is powerful, efficient and very maneuverable and versatile because it is capable of performing substantially all work related to the teardown of an inner refractory wall of a blast furnace, including the breakup of refractory material about the salamander in the lower hearth and/or bosh regions of a furnace, with a minimum of vertical adjustments.

A particularly significant object is to provide a structure, equipment or apparatus in which the support and carriage thereof, alluded to above, are substantially rectangular or oblong in character and the carriage is provided with operating means including a backhoe which is mounted at or on one corner of the carriage, thereby enabling it to operate within very close limits or quarters, such as in the upper area or top of a furnace, and since the furnace progressively increases in diameter for an appreciable distance downwardly, the boom and related components thereof and operating tool can be readily swung out or extended to an extremely long reaching radius from the vertical center line of the furnace, as compared to other machines, such as, for example, the one disclosed in the above mentioned Skendrovic Patent where the working radius is less since its boom is substantially coincidental with the vertical axis of the machine.

Otherwise expressed, the location of the backhoe at or adjacent to one corner of the carriage offers a setup which enables it to be moved closer to the inner refractory wall of a furnace and also allows the operator to manipulate the hoe in a substantially straight down or depending position in order to facilitate breaking up of material about the salamander in the hearth and bosh areas as alluded to above.

A specific object is to provide the carriage with an extendible or reciprocal shelf, under the control of the operator, which when extended may serve as a rest for the backhoe to facilitate maintenance or repair thereof.

A significant objective is to provide a machine for the purpose which is provided with self-contained power means and cable means which is operable thereby and controllable by an operator on the machine whereby the machine can be readily adjusted and held in any one of an infinite number of radial and/or circumferential stable positions in a furance to facilitate locating the tool on the backhoe in closer proximity to its refractory wall for demolition.

A further object of the invention is to provide a unique means for rotatably connecting the support and carriage, including a well or tube through which an operator can readily pass therethrough from the support to the carriage and viceversa.

Other attributes of the invention reside in providing structure which is: relatively compact to facilitate its transport without a permit and its entry into and from a furnace, durable, and the components thereof are located to promote efficiency, balance, operation, and facilitate maintenance, repair or replacement thereof.

Additional objectives and advantages of the invention or inventions embodied in the subject application will become apparent after the description hereinafter set forth is considered in conjunction with the drawings annexed thereto.

DRAWINGS

In the drawings:

FIG. 1 is a side elevational view of the equipment embodying the subject invention;

FIG. 2 is a top view of the structure shown in FIG. 1;

FIG. 8 is a section showing one mode of attaching cables to the sides of the furnace.

DESCRIPTION

Figure 3:
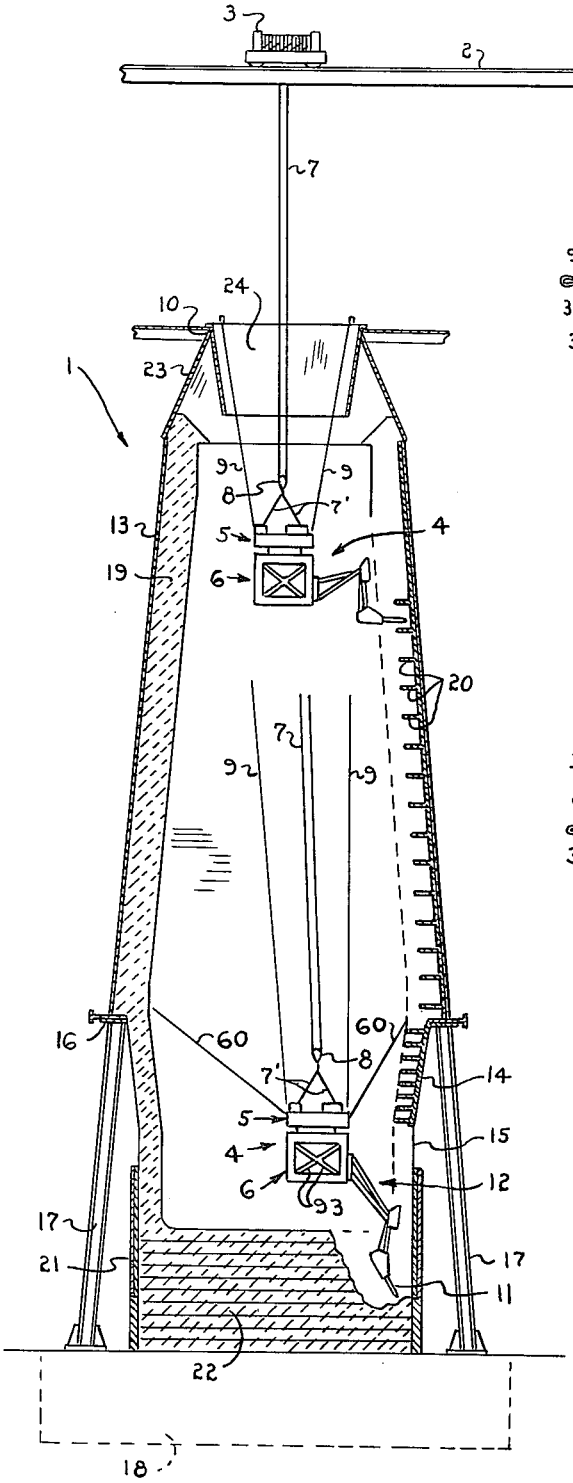
FIG. 3 is a vertical section of a blast furnace depicting the structure of FIG. 1 disposed within the confines of this furnace.

Referring first to FIG. 3 of the drawing there is depicted a blast furnace generally designated 1, an overhead beam 2, a hoisting mechanism 3 movable on the beam and a machine or structure generally designated 4, embodying the subject invention, which comprises, among other things, an upper support or platform generally designated 5, and a lower carriage or cage generally designated 6, which are operatively connected for relative rotation. Means are provided for suspending the structure 4 within the confines of the furnace, and this includes what may be termed a primary cable 7, which is connected to the mechanism 3 and four secondary cables 7', (two are shown in FIG. 3) which are connected to the support 5 and to the primary cable by a pulley 8, the arrangement being such that the mechanism 3 can be operated on the beam by an individual located exteriorly of the furnace to correctly position the structure 4 with respect to an upper opening 10 in the furnace and control the lowering or raising thereof to any desired operative elevation, particularly within the confines of the furnace so that an air operated tool or hammer 11 mounted on a backhoe generally designated 12 connected to the carriage 6 can be located in any one of an infinite number of positions to perform its intended purpose. The support is also provided with four cables 9, the purpose of which will be described later.

In order to obtain a better understanding of the disclosure, a brief description of the furnace 1 is considered to be appropriate. Furnaces of the character shown are generally cylindrical and of variable cross-dimensions and comprise an outer shell or casing of steel having an upper elongated portion or stack 3 which tapers upwardly, an intermediate shorter portion or bosh area 14 which tapers downwardly, and a bottom cylindrical portion or hearth area 15. A mantel 16 surrounds the furnace at the junction between the portions 13 and 14 and an outer portion of this mantel is engaged by circumferentially spaced legs 17 which are anchored to a foundation 18 for supporting the furnace in the elevated or vertical portion shown. The furnace also includes an inner wall or liner of masonary or refractory material 19 and the portion thereof within the confines of the portion 13 is relatively thick and supported on an inner or inwardly extending portion of the mantel 16, and the portion of the wall 19 within the confines of the intermediate portion of bosh area 14 of the casing may have a thickness somewhat less than that within the stack portion 13. The upper and intermediate portion 13 and 14 of the casing are provided with water cooled units 20 projecting inwardly whereby to cool the furnace and facilitate support for the refractory material. The lower cylindrical portion or hearth area 15 is partially surrounded with a water cooled jacket 21 (details not shown) and a thick mass of material 22 comprised of blocks or bricks of carbon or refractory material is disposed in the bottom of the portion 15 and supported on the foundation 18 between the legs 17. The means for supplying and circulating water to the cooler units and jacket are not shown.

The furnace is provided with a metal frustoconical cap 23 at the opening 10 and a funnel or hopper 24 which has an upper edge supported on an upper rim of the cap to facilitate entry of material into the furnace. The structure 4 is of a size to pass through the funnel 24 but if so desired this funnel may be removed.

The height of such furnaces vary. For example, the height from the mantel 16 to the top of the furnace may range in the neighborhood of between 50' and 70', and the range from the mantel to the bottom may be within 40' to 50'. The diameter of the furnace at the mantel may be within a range of 38' to 50'; the diameter of the jacket in the neighborhood of 35' and the thickness of the inner wall may vary within a range of 38" to 54". These dimensions are not critical and have no bearing on the subject invention other than to show their relativity with respect to problems confronting the operation of the structure 4 in demolishing or tearing down the inner wall 19.

SUPPORT

The structural characteristics of the support or platform 5 constituting a component of the structure 4 and its relationship to the carriage 6 therebelow will now be described with particular reference to FIGS. 1, 2, 4, and 6.

The support may be designed and constructed in various ways but is preferably made rectangular or oblong, as alluded to above, and includes, among other things, a pair of side I-beams 25 and 26 and a pair of end I-beams 27 and 28 to form a frame. The corners of the support are provided with upstanding apertured lugs 29 and the four cables 7' fastened to the pulley 8 have devices 30 fastened thereto which are attached to the lugs to provide a part of the primary suspension means from the hoisting mechanism 3 carried by the beam 2.

Figure 5:
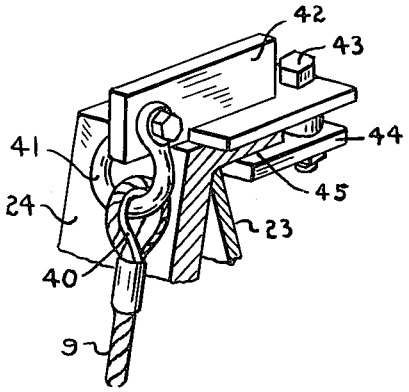
FIG. 5 is an enlarged partial perspective view showing one mode of attaching one of four safety cables from the support to the top of the furnace.

The support is also provided with means for promoting its safety in the operation of the structure and this means preferably includes four manually operable reels 31, 32, 33 and 34 located in the interior of the support at its four corners. The pair of reels 31 and 32 are mounted on an interior shelf 35 at one end of the support and the pair 33 and 34 are mounted on a shelf 36 at the other end of the support. It should be observed that the cable from the reel 31 extends through a clamping device 37 generally designated, out through an opening provided therefor in side beam 26 and against a roller 38 and that the cable from the adjacent reel 32 similarly extends through the device 37 and out through an opening in the opposite side beam 25 for engagement with a roller. The cables on the other pair of reels 33 and 34 extend through a clamping device generally designated 39 corresponding to the device 37 and out through openings in the side beams and against rollers 38 in a manner substantially corresponding to the cables on the reels 31 and 32. As shown in FIG. 5, the outer ends of these safety cables are respectively provided with eyes 40 connected to clevices 41 which are adapted for detachable connection to fittings 42, the latter of which are detachably connected by bolts 43 to an annular ring 44 surrounding the cap 23. The bolts, which are circumferentially spaced, extend through base portions of the fittings 42 and ring 44 and clamp an outwardly extending radial flange 45 of the funnel 24 therebetween.

The clamping devices 37 and 39 for the safety cables 9, above referred to, may be designed and constructed in various ways, but each device preferably comprises a pair of fixed plates 37' provided with a multiplicity of pairs of holes through which U-bolts 46 extend for firmly clamping any portions of the cables at a plurality of locations to the plates so that the length of those portions of all of the cables extending between the reels and their ends connected to the top of the furnace can be correlated with the primary and secondary cables 7 and 7' whereby to provide, if so desired, additional or supplemental suspension supporting means for the structure 4 and particularly promote safety and assist in stabilizing its central position in the furnace. The foregoing arrangement facilitates independent adjustment of the cables 9 with respect to one another and the primary suspension system. Otherwise expressed, a primary suspension means is provided and a secondary one as a safety factor in the event the primary means should fail.

As set forth above one of the important objects of the subject invention is to provide equipment, a machine or structure with means whereby an operator seated in the structure can readily control movement of the structure to anyone of an infinite number of stabilized positions about the vertical, longitudinal or central axis of the furnace whereby the backhoe and tool carried thereby can be readily and efficiently operated to demolish the liner. The means for achieving this objective will now be described.

Figure 6:
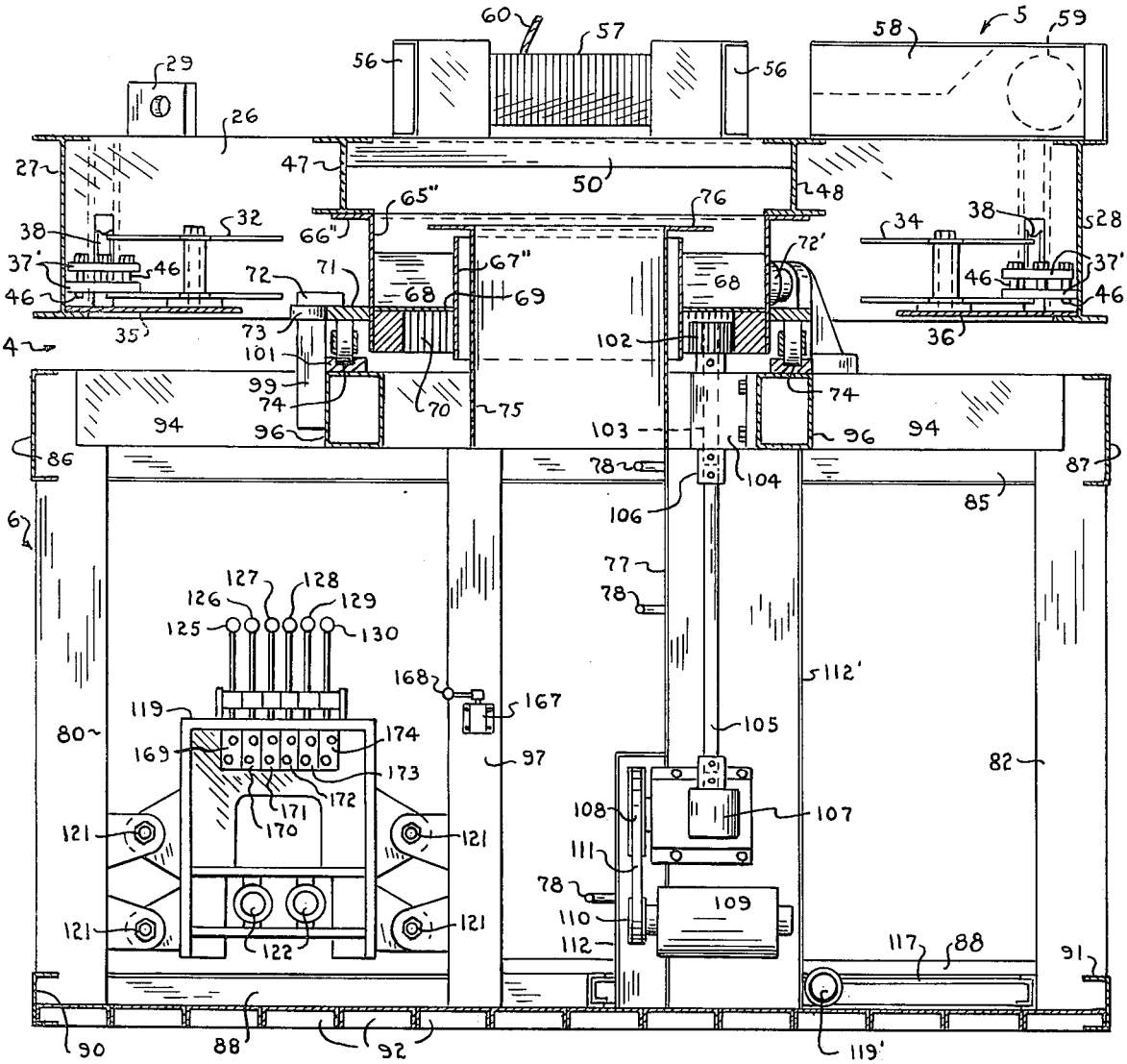
FIG. 6 is a vertical section taken substantially on line 6—6 of FIG. 1.

The support 5 is suitably braced and, as shown in FIGS. 2 and 6, includes a pair of intermediate transverse parallel cross-beams 47 and 48, and a pair of longitudinally extending parallel members 49 and 50 joining these beams. A pair of upstanding plates 51 and 52 join the end beam 27 and cross-beam 47 and support a winch or reel 53. The side beam 25 and beam 49 are similarly provided with upstanding plates 54 which carry a winch 55 and the other side beam 26 and member 50 have plates 56 which support a winch 57 and plates 58 are provided on the other end beam 28 and other cross-beam 48 for supporting a winch 59. The winches are operable independently of one another and it should be noted that the winches 53 and 59 are disposed generally diagonally and that the winches 55 and 57 are located substantially intermediate the length of side beams 25 and 26 of the support, the purpose of which is to correctly distribute the weight load for purposes of balance and stabilization. The four winches carry cables or cable means 60 which have ends provided with means, such as clevices 61 for detachable connection with the sides of the furnace. More particularly in this respect, and as illustrated in FIG. 8, there is shown in dotted lines one of the cooler units 20 extending into the furnace. These units are replaceable and each is attached to means such as a fitting 62 anchored to the outer wall of the furnace and after the furnace is shut down for demolishing at least a portion of the liner, certain of the units, particularly those equally or approximately circumferentially spaced apart 90°, may be removed, in which event, the devices 61 on the cables 60 can be extended outwardly through the openings, formally closed by the cooler units, and then firmly detachably secured to the fittings 62 as desired, such as by passing bolts or pins 63 through the devices and apertures provided therefor in the fittings. This particular setup for attaching the winch cables 60 to the furnace may obviously be modified. For example, the cables can be, preferably above the hearth secured to any external area, of the furnace by any means suitable for the purpose and it is desirable that connections of the cables to the furnace be spaced apart sufficiently, such as substantially 90°, to facilitate movement of the structure to any location within 360° as well as promote stability at the location or station selected for demolishing the liner.

Figure 9:
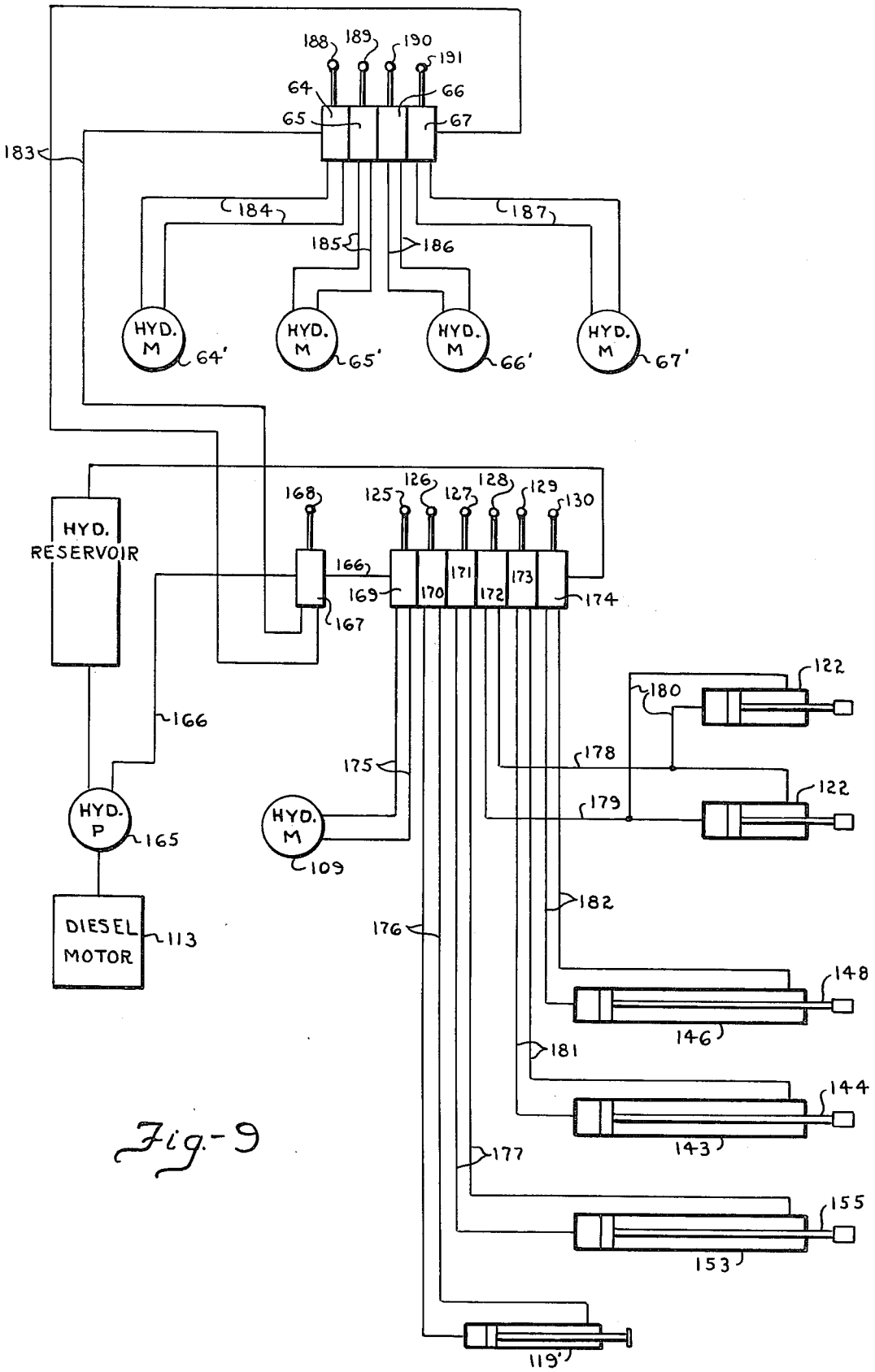
FIG. 9 is a diagram of the hydraulic system and controls therefor.

The winches 53, 55, 57 and 59 are respectively hydraulically controlled by four double action valves 64, 65, 66, and 67 having control levers as shown in FIGS. 2 and 9 for independently controlling the operation of four reversible motors 64', 65', 66' and 67' for rotating of the winches clockwise or counter-clockwise so that, for example, the pair of diagonally disposed winches 53 and 59 can be operated to cause the cables to swing the structure 4 generally in an arc in a diametrical plane toward or away from opposite sides of the furnace and the pair of winches 55 and 57 on the opposite sides of the support 5 can be operated to swing the structure generally in a diametrical plane substantially transverse to said first mentioned plance. Also, if so desired the winches 53 and 57 can be operated in conjunction with winches 55 and 60 to swing the structure in variable planes between or bisecting those just referred to. It should be noted that the aforementioned motors, as disclosed in the hydraulic circuitry in FIG. 9, also carry the legend HYD-M and the pump 165 HYD - P. Since the winches are independently reversibly operable through the agency of the motors the structure 4 can be moved to any position desired to place the backhoe 12 and/or tool 11 carried thereby closer to the liner or refractory wall 19 for tear down.

It should be observed that the location of the winches and cables 61 thereon are predetermined so that they are readily accessible, and operable without material interference from the primary cable 7 and safety cables 7' and reels therefor. In any event, it is to be distinctly understood that this organization of winches and cables or cable means extending therefrom for connecting the support and/or structure to the wall of a furnace for disposition about its vertical axis is considered to constitute a meritorious advance in the art.

Figure 4:
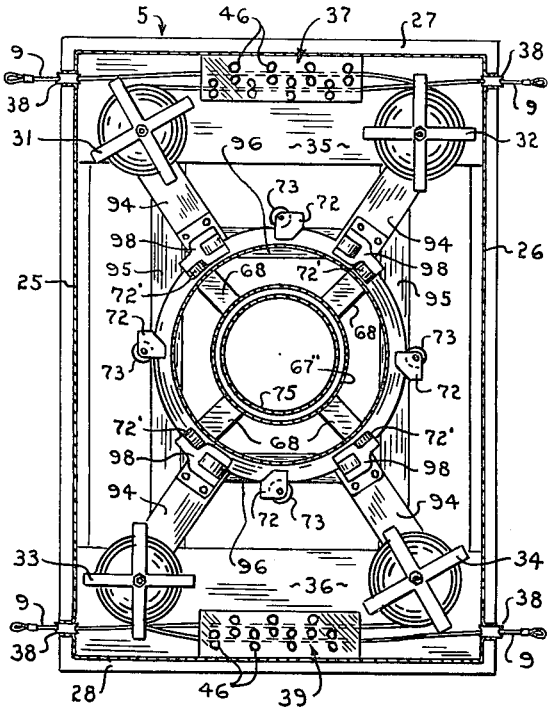
FIG. 4 is a horizontal section taken substantially on line 4—4 of a support of the structure shown in FIG. 1.

The support 5 as depicted in FIGS. 2, 4 and 6, is further provided with a relatively large vertical center cylinder annular member or tubular formation 65" having an upper laterally extending or radial flange 66" which is welded or otherwise secured to the underside of the cross beams 47 and 48 and a cylindrical tubular member 67" is fixedly secured in a concentric spaced relation substantially within the confines of the cylinder 65" by circumferentially spaced radially extending braces 68. A heavy plate 69 is secured between the cylinder 65" and member 67" and to the underside of the braces 68 and a ring gear 70 is fixedly secured to the underside of the plate 69 and to a lower portion of the cylinder 65". The cylinder 65" is also provided with a relatively thick annular radial flange 71, below the flange 66", for cooperation with hooks or fixed means 72, top rollers or bearings 72', side rollers or bearings 73 and bottom rollers or bearings 74 mounted on the carriage or cage 6 in a manner which will be described subsequently.

In order to facilitate access from the support into and out of the carriage by an operator, the structure 6 is provided with a centrally disposed cylinder or tube 75 which is fixedly secured to radial braces 94 to constitute a manhole or well. This tube is concentrically disposed in the member 67" and is provided with an annular radial flange 76 disposed in overlying spaced relation to the upper end of member 67" for safety purposes and with a lower relatively narrow depending continuation 77 which extends into the carriage and is provided with steps 78 whereby to facilitate entry into the carriage from the support so that an operator may readily obtain access to the equipment mounted on the carriage and/or on the support, including the controls therefor or find his seat 79.

CARRIAGE

The structure of the carriage 6 and its operative relationship with the support 5 will now be described. The carriage may be designed and constructed in various ways but as illustrated particularly in FIGS. 1, 6 and 7, it is preferably made rectangular or oblong, similar to the support 5, and comprises, among other things, a framework having four hollow corner posts 80, 81, 82 and 83, a pair of upper parallel side rails 84 and 85 and a pair of upper parallel end members 86 and 87 secured to the upper ends of the posts; a pair of lower side rails 88 and 89 and a pair of lower end members 90 and 91 and a sectionalized lower bottom or floor 92. These side rails and end members and floor are preferably of channel shape. The corner posts at the ends of the frame are preferably re-inforced by cross braces 93 as shown in FIG. 1; the upper part of the frame by four diagonal braces 94, a pair of side braces 95 and a pair of end braces 96, as shown in FIGS. 4 and 6; and by a pillar 97 as shown in FIGS. 6 and 7.

The unique means employed for rotatably connecting the carriage to the support will now be described. The diagonal braces 94, above referred to, are respectively provided with circumferentially spaced lugs 98 which carry the top rollers or bearings 72' for engaging an upper surface of the annular flange 71 on the cylinder 65" of the support and the side and end braces 95 and 96 are provided with upstanding fittings 99 which carry the side rollers or bearings 73 which engage a marginal edge portion of the flange and the hooks, abutments or inwardly extending ears 72 which overlie the flange. The carriage is also provided with an annular grooved ring 101 secured on the top of the braces 94, 95 and 96 and the bottom rollers 74 which are carried by lower ends of the fittings 99 ride in the groove or track. The rollers and hooks are circumferentially spaced for cooperation with the flange 76 to afford a relatively annular stable rotatable assembly or means for connecting the support and carriage and which enables the carriage to rotate within and in excess of a range of 360° relative to the support, such excess being limited by the disposition of conduits for the hydraulic fluid. This factor is important as it permits an operator to readily locate the operating tool 11 in a greater rotational range for operation against the liner 19. It should be observed that the bottom rollers 74 serve the dual purpose of spacing the support and carriage a sufficient distance apart whereby to appreciably reduce friction to obtain a smooth and efficient rotatable connection. It should also be noted that the well or tube member 75 extends through this rotatable connection and so that an operator may freely pass or travel therethrough, as alluded to above. Attention is directed to the fact that in the event the rotatable assembly or connection between the support and carriage should inadvertently fail, the flange 71 on the well 75 fixed on the carriage will engage the cylinder member 67" fixed on the support. This factor of safety is desirable in such equipment.

Figure 7:
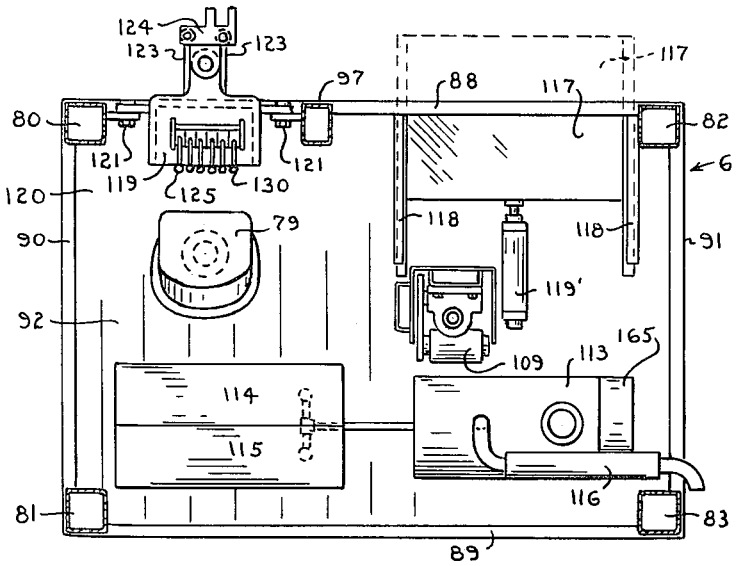
FIG. 7 is a horizontal section taken substantially on line 7—7 through the carriage of the structure of FIG. 1.

As shown in FIGS. 6 and 7 the carriage is also provided with a vertical drive shaft means having a pinion gear 102 at its upper end for engaging the annular gear 70 on the support 5 to effect rotation of the carriage relative to the support. More specifically in this regard, the shaft means has an upper section 103 journalled in a bearing 104 which carries the pinion 102 and a lower section 105 which is connected to the upper section by a coupling 106 and to a worm gear reduction box 107. A shaft from this box carries a large sprocket 108 and a hydraulic motor 109 has a shaft carrying a smaller sprocket 110, and a chain belt 111 operatively connects these two sprockets. Vertical shields or members 112 and 112' protect the operating mechanism, including the shaft, gear box, motor, and the sprockets and chain.

A small diesel motor 113, having a rating preferably of 188 cubic inches is mounted on the carriage and constitutes the power means for operating a pump and the hydraulic system for effecting relative rotation between the support and carriage and other components. Any diesel having a rating of between 150 and 200 cubic inches may be utilized. A double walled structure forms a tank 114 for hydraulic fluid and a tank 115 for fuel for operating the diesel. An exhaust 116 is provided for the diesel motor.

The seat 79 for an operator is disposed between the tank structure and the backhoe 12 at one extremity of the carriage and the diesel 113 and an extensible member or platform 117 constituting a rest or support for the hoe 12 is disposed at the opposite extremity of the carriage, with the motor 109 for driving the pinion shaft being located between the diesel and platform, all for the purpose of promoting balance, stabilization and access to the various components for maintenance, replacement or repair and particularly facilitate access and repair to the hoe when it is placed on the platform alongside the carriage as depicted in FIG. 2.

The platform 117 comprises a reciprocal plate mounted in parallel guides 118 above the floor 92 and is operable by a cylinder 119' tied in with the hydraulic system and under the control of the operator so that the plate may be extended from the full line retracted position to an extended dotted line position as shown in FIG. 7.

The backhoe 12 and its structural relationship to the carriage will now be described. It is to be understood that the use of the term "backhoe" is one employed in the trade, notwithstanding the fact that it may not be considered to be entirely appropriate. Perhaps a more accurate term would be an elongated "articulated assembly". In any event, the structure of the hoe or articulated assembly 12 comprises a multitude of components which are conventional.

More particularly, and as best illustrated in FIGS. 1, 2, 6, 7 and 9 a relatively heavy cast mounting forming a housing 119 which is mounted on a base 120 above the floor 92 and firmly anchored by bolts 121 or otherwise to the pillar 97 and the adjacent corner post 80 of the carriage. This housing has a lower area in which a pair of master cylinders 122, as shown in FIGS. 6 and 9, are disposed and piston rods 123 which are connected to an upstanding mounting 124 of the hoe 12 and an upper area in which double action hydraulic valving is disposed and an opening through which conduits extend from the valving to the various hydraulically operated components. It should be noted that the mountings 119 and 124 are located at one planar side of the carriage adjacent to one corner or post 80 and that the platform 117 is also located at this side and adjacent to the post 82. All of the details of this particular structure are not shown since they are considered to be of a conventional character. The housing 119 is also provided with six manually operable upstanding levers or members 125, 126, 127, 128, 129 and 130 located in front of the operators seat 79 for conveniently selectively controlling the hydraulic operable components and with suitable gauges or means for indicating the condition of the components, certain of which will be described subsequently. The cylinders 122 serve to control pivotation of the hoe. The housing is also provided with upper and lower outwardly extending apertured lugs 131 and 132. The upstanding mounting 124 has upper and lower apertured bifurcations 133 and 134 which respectively receive the upper and lower lugs and pivots which extend through the apertures in the bifurcations and lugs to pivotally connect the mounting to the housing 119. The upper end of the mounting is also provided with an apertured offset 135 and its lower extremity is in the form of a channel 136. The hoe 12, as noted above, is articulated and includes a boom 137, the inner end of which is disposed in and connected to the channel 136 by a pivot 138 and a generally elongated structure commonly referred to and generally designated as a dipper 139 is connected by a pivot 140 to the outer end of the boom. This dipper includes an inner enlarged generally channel extremity 141 and an outer extended extremity 142. A boom cylinder 143 has an inner end pivotally connected to the offset 135 on the mounting 124 and its rod 144 is pivotally connected at 145 to the boom at a location spaced inwardly from the pivotal connection between the dipper and boom. A cylinder 146 has an inner end pivotally connected at 147 to the boom at a location between the pivotal connections 138 and 145 and its rod 148 is pivotally connected at 149 to an inner offset 150 on the dipper. The boom cylinder 143 is operable to raise and lower the boom and the cylinder 146 serves to pivot the dipper relative to the boom. A channel member 151 is connected intermediate its ends by a pivot 152 to the outer end of the dipper 139. A cylinder 153 is connected by a pivot 154 to the dipper at a location under and adjacent the junction between the extremities of the dipper and its rod 155 is pivotally connected at 156 to the inner ends of a pair of links 157 and 158. One end of the link 157 is pivotally connected at 159 to the outer end of the dipper above the pivot 152 and one end of the link 158 is pivotally connected at 160 to the rear portion of the channel 151. The cylinder 153 and its rod serve to pivot the channel 151 and tool structure carried thereby, as a unit, relative to the dipper.

The channel 151 has a base wall 161 and a downturned apertured portion 162. A cylinder 163 is secured to the underside of this base wall and to the portion 162 and compressed air through a conduit 164 from a supply tank (not shown) serves to reciprocate the tool 11 in response to the actuation of a control lever by the operation on the carriage.

Attention is directed to the important fact that due to the improved principles of design and construction embodied in the support and carriage and particularly the disposition and operation of the backhoe substantially any conventional blast furnace now in use can be delined by adjusting or lowering the complete structure to a minimum number of suspended positions, such as for example, 2, 3 or 4, in a furnace and in this respect note the extended reach of the tool on the backhoe whereby the material about the salamander can be demolished as exemplified in FIG. 3. It should also be manifest that the location of the means for supporting the tool is predetermined so that when the machine or structure is suspended substantially on the vertical axis of the furnace that the radial distance from this axis to such location is in the neighborhood of 5 feet.

HYDRAULIC SYSTEM

The hydraulic system diagrammed in FIG. 9 will now be described. The system is primarily comprised of standard or conventional components and includes the diesel motor 113 which operates a pump 165 for causing hydraulic fluid to flow through a line 166 to a double action valve 167 having a lever 168. The line 166 is also connected to six double action valves 169, 170, 171, 172, 173 and 174 which are respectively subject to the control of the levers 125, 126, 127, 128, 129 and 130. A pair of lines 175 connect the valve 169 to the motor 109; a pair of lines 176 connect the valve 170 to the cylinder 119; a pair of lines 177 connect the valve 171 to the cylinder 153; a pair of lines 178 and 179 connect the valve 172 to one of the master cylinders 122 and a pair of branch lines 180 which respectively connect lines 178 and 179 to the other master cylinder 122; a pair of lines 181 connect the valve 173 to the cylinder 143; and a pair of lines 182 connect the valve 174 to the cylinder 146. It should be observed that the lines 166 serves to control the operation of the four motors which effect reversible rotation of winches. All of the levers 125 through 130 and the other levers disclosed herein are preferably so constructed that when they are moved forwardly the valves will control the flow of the fluid to the cylinders to effect a forward motion to the rods and rearward movement will effect retraction of the rods.

More specifically, the above organization is preferably such that the lever 125 can be manipulated to control the operation of the motor 109 for effecting relative rotational movement between the support 5 and the carriage 6; the lever 126 to operate the cylinder 119 to effect reciprocation of the platform 117 for the hoe 12; the lever 127 to control the valve 171 to effect operation of the cylinder 153 to impart motion to the tool assembly; the lever 128 to control the operation of the valve 172 to control the master cylinders 122 to impart pivotal motion to the hoe 12; the lever 129 to control the valve 173 to operate the cylinder 143 to effect pivoting of the boom relative to its mounting 124; and the lever 130 for controlling valve 174 to control the cylinder 146 for effecting pivotation of the dipper 139 relative to the boom 137. The valve 167 is connected to the line 166 and a pair of lines 183 connect this valve to the valves 64, 65, 66 and 67, the latter of which are respectively connected to the motors 64', 65', 66', and 67', by pairs of lines 184, 185, 186 and 187. The valves 64, 65, 66 and 67 are respectively provided with hand operable levers 188, 189, 190 and 191, and the operation of these levers respectively control the operation of the valves to impart reversible rotation to the motors 64', 65', 66', and 67' which in turn respectively operate the winches 53, 55, 57 and 59 to shorten or lengthen the cable means 60 whereby the structure 4 can be readily swung or moved to any operative position desired for delining the masonary or inner refractory wall 19 of the furnace. It should be noted that the motors for operating the winches are subject to the primary control lever 168 so that if, for example, the levers related to these motors are all moved forwardly and the lever 169 is also moved forwardly the motors will be caused to function or operate simultaneously.

SUMMARY

Summarizing the foregoing it should be manifest that the machine embodying the subject invention or inventions comprises the important improvement whereby the machine can be readily swung outwardly from a suspended substantially center position in a furnace to any one of an infinite number of closer stable positions to its inner masonry wall whereby to facilitate operation of a tool thereagainst.

It will also be apparent that the improvement includes a self-contained power means on the machine which is subject to the control of an operator thereon for effecting the adjustment or movement of the machine away from its normal center position.

Further, the safety cable means can be manually adjusted by the operator after the primary suspension means has been adjusted by other individuals outside the furnace.

Also, the location of the backhoe at one corner of the machine is considered to be an important feature of the invention, as alluded to above.

It will be further apparent that the invention offers advantages with respect to its transport, compactness, efficiency of operation, durability and ready access to substantially all of the components whereby to facilitate their maintenance, repair or replacement.

Having thus described our invention or inventions, it is obvious that various modifications may be made in the same without departing from the spirit of the invention and, therefore, we do not wish to be understood as limiting ourselves to the exact forms, constructions, arrangements, and combinations of the parts herein shown and described.

We claim:

1. A machine for use in a substantially cylindrical furnace having a vertical center axis and an inner masonry wall, said machine comprising structure provided with means for supporting a tool for demolishing at least a portion of said wall, means for suspending said structure in such a furnace, (and power operated) cable means carried by said structure (and operable independently of said suspension means) for connection with means on said furnace; and power means operable independently of said suspension means whereby said structure can be adjusted and secured centrally in said furnace or in any one of an infinite number of radial and/or circumferential stable position about such an axis in order to facilitate locating such a tool variable distances away from such an axis for operation against said wall.

2. The machine described in claim 1, including self-contained power means carried by said structure which is subject to control by an operator on said machine for operating said cable means.

3. The machine defined in claim 1, in which such a furnace is of an appreciable height and has a hearth area, and the means on such a furnace for connection with said cable means are located above the hearth area.

4. In combination: a support provided with cables for suspending it in a furnace having an outer metal wall and an inner masonry wall, a carriage provided with a tool for demolishing said wall, centrally disposed means connecting said carriage to said support for rotation therebelow, and a plurality of power operated cable means carried by said support for connection with said metal wall whereby said support and carriage as a unit may be swung and held in substantially any radial position desired toward said inner wall so that said tool is located closer to this wall to facilitate its demolition.

5. In combination: a support provided with cable means whereby to facilitate suspending it substantially in a central position in a substantially cylindrical upstanding furnace having an inner masonry wall, a carriage provided with a pneumatically operated tool for demolishing at least a portion of said wall, centrally disposed substantially annular means providing a rotatable connection between said support and carriage for locating the latter below said support, and said support being provided with a plurality of power operated cable means for attachment to such a furnace whereby said support and carriage, as a unit, may be swung away from its center position toward said wall to locate said tool closer thereto in order to facilitate its demolition.

6. The combination defined in claim 5, in which said support and carriage are substantially oblong in shape and said tool is located at one extremity of said carriage for normal disposition between the center of such a furnace and its inner wall.

7. A subassembly constituting a support connected to a carriage therebelow, cable means whereby the support may be suspended in a substantially cylindrical upstanding furnace having an inner masonry wall, and a plurality of power operated cable means carried by said support for detachable connection with such a furnace whereby said support can be swung generally radially toward and away from said wall whereby to facilitate demolishing at least a portion thereof by a tool adapted for operation from said carriage.

8. The combination defined in claim 7, including means on said support and means on said carriage adapted for engagement to prevent separation of said carriage from said support in the event said annular connecting means should fail to support said carriage.

9. The combination defined in claim 7, including a tubular member carried by said support and a tube member carried by said carriage, said members are concentrically spaced, said annular connecting means is disposed in said space, said tube member extends upwardly into said tubular member, and means are provided on one member for engagement with the other whereby to prevent separation of said carriage from said support in the event said annular connecting means fails to support said carriage.

10. In combination: a carriage having a tool mounted thereon, structure rotatably connected to and supporting said carriage therebeneath, cables extendible from said structure whereby to facilitate suspending it substantially in a normal central position in an upstanding substantially cylindrical furnace having an inner masonry wall, and a plurality of power operated cable means carried by said structure connectible to said furnace whereby the structure and said carriage as a unit may be swung outwardly from the central position to locate the tool closer to said wall whereby to facilitate its demolition thereby.

11. A machine of the kind described comprising a carriage and a support, means for rotatably connecting said carriage and support, said carriage having a side provided with a mounting, an elongated articulated structure having an inner end pivotally connected to said mounting and an outer end provided with a tool, and said side also being provided with a movable member spaced from said mounting which can be moved outwardly with reference to said side so that said structure may be pivoted to rest thereon.

12. The machine defined in claim 11, including power means disposed substantially within the confines of said carriage for operating said connecting means and said movable member.

13. The machine defined in claim 11, including means provided on said support whereby to facilitate suspending it within the confines of an upstanding substantially cylindrical furnace having an inner lining of masonry, and cable means for connecting said support and furnace whereby said support and carriage, as a unit, may be moved toward and away from said wall.

14. The machine defined in claim 11, in which said carriage is substantially rectangular in shape and said mounting is located adjacent one corner thereof and said movable member is located adjacent an opposite corner.

15. A machine of the kind described comprising a carriage structure provided with means for supporting a tool and a support structure provided with means for suspending it within the confines of a furnace, centrally disposed substantially annular means providing a rotatable connection between said structures, said annular means comprising an annular flange mounted on said support which has annular upper, lower and edge surfaces, and said carriage is provided with three sets of circumferentially spaced bearings which are respectively engageable with said upper, lower and edge surfaces of said flange.

16. The machine defined in claim 15, in which said carriage is also provided with circumferentially spaced fixed means which overlie said flange.

17. The machine defined in claim 15, including a tubular formation which is carried by said support and disposed centrally in said annular means, and a tube which is carried by said carriage and extends upwardly into said tubular formation whereby to afford passage of an individual to and from said structures.

18. A machine for use in a substantially cylindrical upstanding furnace having a vertical center axis and stack structure above a hearth area having an outer wall and an inner masonry wall, said machine comprising a tool for demolishing at least a portion of said inner wall, means for connection with an overhead support whereby the machine can be suspended in a furnace, cable means on said machine extending through openings in said stack structure for connection with means externally thereof whereby said machine can be adjustably positioned and secured in any one of a number of infinite stable positions between said axis and said inner wall in order to facilitate locating said tool variable radial operative distances for demolishing said inner wall, and self-contained power means on said machine for control by an operator thereon for operating said cable means independently of said suspension means.

19. In combination: structure comprising a support, a carriage provided with a tool, means connecting said support and carriage for relative rotation, cables extending from said support for suspending the same and said carriage, as a unit, in an upstanding furnace having an inner masonry wall, power operated cable means extending from said structure connectible with said furnace whereby the unit can be swung outwardly to locate said tool closer to said wall to facilitate demolition of at least a portion thereof, said support having a centrally disposed tubular formation and said carriage having tubular means extending upwardly into said tubular formation and being provided with means for safety engagement with said tubular formation for the purpose described.

20. In combination: a support and a carriage, means providing a rotatable connection therebetween, said carriage being generally oblong in shape and having a generally planar side provided with a mounting located at one extremity of said carriage, elongated structure having an inner end, means pivotally connecting this end to said mounting and an outer end provided with a reciprocal tool for demolishing at least a portion of an inner generally cylindrical masonry wall of an upstanding furnace having a vertical center axis, said support being provided with cables for normally suspending said support and carriage as a unit whereby said planar side is disposed in a generally chordal position with reference to said axis and the distance between this axis and said pivotally connecting means is in the neighborhood of 5 feet.

21. The combination defined in claim 20, in which said support is provided with power actuated cable means which are connectible to such a furnace whereby said unit can be swung outwardly from said range and held in a position to locate the tool closer to such a wall to facilitate its demolition.

22. In combination: structure comprising a support, a carriage provided with a tool, means connecting said support and carriage for relative rotation, cables extending from said support for suspending the same and said carriage from an overhead beam in an upstanding furnace having an inner masonry wall and a hearth area, a plurality of power operated cable means extending from said structure connectible with said furnace above the hearth area whereby the unit can be swung outwardly to locate said tool closer to said wall to facilitate demolition of at least a portion thereof, and additional cable means extending from said structure connectible with a top portion of such a furnace for supporting the structure in the event said suspending cables should fail in supporting said structure.

23. In combination: an upstanding substantially cylindrical furnace having an inner masonry wall and a vertical central axis, a support, cables whereby to facilitate suspending said support in said furnace substantially on said axis, a carriage provided with a pneumatically operated tool for demolishing at least a portion of said wall, centrally disposed substantially annular means providing a rotatable connection between said support and carriage for locating the latter below said support, and said support being provided with a plurality of power operated cable means for attachment to said furnace whereby said support and carriage as a unit may be swung away from said axis toward said wall to locate said tool closer thereto in order to facilitate its demolition.

24. The combination defined in claim 23, in which said carriage is substantially oblong in shape and said tool is located at one extremity of said carriage for normal disposition between said axis and inner wall of such a furnace.

25. The combination defined in claim 23, including self contained power means mounted on said carriage for control by an operator thereon for operating said cable means.

26. Structure comprising a support and a carriage operatively connected to said support, cables whereby the support may be suspended from an overhead beam in a substantially cylindrical upstanding furnace having an inner masonry wall, a first set of cable means carried by said support for adjustable connection with such a furnace for suspending said support in the event that said first set of cables should fail, and a second set of power operated cable means extensible from said support for detachable connection with such a furnace whereby said support and carriage can be swung generally radially toward and away from said wall whereby to facilitate demolishing at least a portion thereof by a tool adapted for operation from said carriage.

27. The structure defined in claim 26, in which said first set of cable means comprises a plurality of manually operable reels mounted on said support and cables extensible from the reels, including clamping means for securing these cables against extension after they have been adjusted for length from said reels.

28. A support adapted for connection with a carriage provided with a tool for demolishing an inner masonry wall of an upstanding furnace, said support having a pair of substantially parallel sides provided with openings and rollers adjacent said openings, a first pair of reels carried by such support located adjacent one of said sides and a second pair of reels carried by said support located adjacent the other side, cables extending from said first pair of reels through the openings and against the rollers at said other side and cables extending from said second pair of reels through the openings and against the rollers at said one side, and clamping means interposed substantially midway between said sides whereby said cables can be firmly secured to said support.

29. A machine for the purpose described comprising an oblong structure provided with means located at one extremity of said structure for supporting a tool, means for connecting said structure to means on a substantially cylindrical outer wall of an upstanding furnace having an inner masonry wall for suspending the structure substantially on a vertical axis of said furnace so that the distance from this axis to said tool supporting means is in the neighborhood of 5 feet, and means for connecting said structure to means on said outer wall whereby said structure can be swung outwardly toward said inner wall to locate the tool closer thereto.

* * * * *

UNITED STATES PATENT OFFICE

CERTIFICATE OF CORRECTION

Patent No. 4,068,895 Dated January 17, 1978

Inventor(s) Roy C. Reese, et al

It is certified that error appears in the above-identified patent and that said Letters Patent are hereby corrected as shown below:

Column 12, line 9, "(and power operated)" should be deleted.

Column 12, lines 10 & 11, "(and operable independently of said suspension means)" should be deleted.

Signed and Sealed this

*Sixteenth* Day of *May 1978*

[SEAL]

*Attest:*

RUTH C. MASON
*Attesting Officer*

LUTRELLE F. PARKER
*Acting Commissioner of Patents and Trademarks*